US009355831B2

(12) United States Patent
Steiner

(10) Patent No.: US 9,355,831 B2
(45) Date of Patent: May 31, 2016

(54) ION GUIDE OR FILTERS WITH SELECTED GAS CONDUCTANCE

(71) Applicant: Urs Steiner, Branford, CT (US)

(72) Inventor: Urs Steiner, Branford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 14/293,073

(22) Filed: Jun. 2, 2014

(65) Prior Publication Data

US 2015/0021492 A1 Jan. 22, 2015

Related U.S. Application Data

(60) Provisional application No. 61/830,231, filed on Jun. 3, 2013.

(51) Int. Cl.
*H01J 49/06* (2006.01)
*H01J 49/42* (2006.01)

(52) U.S. Cl.
CPC ..... *H01J 49/063* (2013.01); *H01J 49/421* (2013.01); *H01J 49/4255* (2013.01)

(58) Field of Classification Search
USPC ..... 250/283, 396 R, 281
See application file for complete search history.

(56) References Cited

U.S. PATENT DOCUMENTS

| | | | | |
|---|---|---|---|---|
| 3,342,993 | A | 9/1967 | Ohalloran | |
| 4,587,432 | A | 5/1986 | Aitken | |
| 5,559,327 | A | 9/1996 | Steiner | |
| 6,049,077 | A | 4/2000 | Franzen | |
| 6,107,628 | A | 8/2000 | Smith | |
| 6,177,668 | B1 | 1/2001 | Hager | |
| 6,465,777 | B1 | 10/2002 | Rache | |
| 6,528,784 | B1 | 3/2003 | Tang | |
| 6,797,950 | B2 * | 9/2004 | Schwartz et al. | 250/292 |
| 7,138,625 | B2 | 11/2006 | Overney | |
| 7,154,086 | B2 | 12/2006 | Laprade | |
| 2003/0071208 | A1 | 4/2003 | Hansen | |
| 2003/0178564 | A1 * | 9/2003 | Kernan | H01J 49/063 250/292 |
| 2004/0036029 | A1 | 2/2004 | Bertsch | |
| 2004/0135080 | A1 | 7/2004 | Ouyang | |
| 2006/0043283 | A1 | 3/2006 | Davis | |
| 2006/0091308 | A1 | 5/2006 | Boyle | |
| 2009/0321624 | A1 | 12/2009 | Fang | |
| 2011/0057097 | A1 * | 3/2011 | Bateman | H01J 49/423 250/283 |

(Continued)

FOREIGN PATENT DOCUMENTS

| | | |
|---|---|---|
| JP | 2005-285543 | 10/2005 |

OTHER PUBLICATIONS

IPRP for PCT/US2014/039900 mailed on Apr. 6, 2015.
ISR/WO for PCT/US2014/040430 mailed on Jan. 13, 2015.

(Continued)

*Primary Examiner* — Phillip A Johnston
*Assistant Examiner* — Hsien Tsai
(74) *Attorney, Agent, or Firm* — Rhodes IP PLC; Christopher R Rhodes

(57) ABSTRACT

Certain embodiments described herein are directed to rod assemblies such as, for example, quadrupole, hexapole and octupole rod assemblies. In some instances, the rod assemblies include at least one pole comprising an integral fluid path configured to fluidically couple an ion volume formed by the assembly to an outer volume of the assembly to remove fluid within the ion volume to the outer volume while containing ions of a selected mass-to-charge range.

20 Claims, 11 Drawing Sheets

(56) References Cited

U.S. PATENT DOCUMENTS

| | | | | |
|---|---|---|---|---|
| 2011/0186733 | A1* | 8/2011 | Schwartz | H01J 49/423 250/290 |
| 2013/0009051 | A1 | 1/2013 | Park | |

OTHER PUBLICATIONS

ISR/WO for PCT/US2014/040445 mailed on Jan. 12, 2015.
ISR/WO for PCT/US2014/040172 mailed on Dec. 10, 2014.

* cited by examiner

ION GUIDE OR FILTERS WITH SELECTED GAS CONDUCTANCE

PRIORITY APPLICATION

This application is related to, and claims priority to, U.S. Provisional Application No. 61/830,231 filed on Jun. 3, 2013, the entire disclosure of which is hereby incorporated herein by reference for all purposes.

TECHNOLOGICAL FIELD

This application is related to ion guides devices and methods of using them. More particularly, certain embodiments described herein are directed to rod assemblies that can be used in ion filters and/or ion guides.

BACKGROUND

Mass spectrometry separates species based on differences in the mass-to-charge (m/z) ratios of the ions. In many cases, the ionization occurs at a different pressure or location than the mass filter. To accommodate these configurations, ion guides and/or crude ion filters can be used.

SUMMARY

Certain features, aspects and embodiments described herein are directed to devices, systems and methods that comprise one or more rod assemblies which comprise a plurality of poles that can be used, for example, to select, transmit or guide ions. In some configurations, the assemblies described herein can be used in devices and system where ions are travelling through different pressure regions while they are focused by electrical fields. In certain configurations, each of the rods of the rod assemblies can be operative as a pole which together may provide a field that can filter and/or guide ions through the device. In other configurations, the multipole assembly can be configured to provide fluidic coupling between an "inside region" (where ions travel) and an "outside region" (where the structure is mounted). In some instances, one or more rods or poles may be configured with an integral fluid path that provides the fluidic coupling between the inside and outside regions of the assembly. The exact configuration of the integral fluid path may vary and illustrative fluid paths, e.g., where one or more rods are serrated, comprise holes, slits or grooves oriented relative to the ion travel axis, are described in more detail herein. The assembly may comprise a single fluid path or a plurality of fluid paths separate from each other but each fluidically coupled to the outside region and/or a pump. As noted herein below, to contain ions within a multipole structure, RF and DC fields can be applied to opposing pole pairs, and these fields may continue along the ion travel axis (though the field may be varied along the ion travel axis if desired). The ion axis may be linear or curved or take other geometries. The rod segments or pole shapes may be any shape, for example round, hyperbolic, square, hexagonal or rectangular.

In certain aspects, the multipole assembly may comprise two or more pressure regions, e.g., an "inside region" or ion volume where the ions travel, and an "outside region" or outer volume, which is the area where the structure is mounted within. While not wishing to be bound by any particular scientific theory, the conductance between the two regions can be determined, at least in part, by the pole geometry. To increase the conductance between the ion volume and the outer volume, one or more rods may comprise an integral fluid path which fluidically couples the ion volume to the outer volume. The fluid path dimensions and spacing can be selected to maintain the electrical fields while increasing the pressure conductance. If desired, the fluid paths may be angled relative to the ion travel axis. To further enhance gas conductance between the ion volume and the outer volume, the dimensions of the fluid path may vary along the poles. For example, where a large gas conductance is desired, the integral fluid path may be larger than where a smaller gas conductance is desired.

In some aspects, the multipole assembly may comprise solid sections where low or no gas conductance is provided and sections comprising integral fluid paths to provide higher gas conductance at those sections. For example, at pressure transition regions of the assembly, it may be desirable to reduce the pressure rapidly using the integral fluid paths in the rods. At sections where no pressure reduction is needed, the rod section may be solid or otherwise not include any integral fluid path. The various different sections may be sized and arranged differently, may be electrically isolated from each other, may include a different number of poles and may be used with many different types of interfaces including atmospheric pressure interfaces and non-atmospheric pressure interfaces. The exact number of sections may vary and illustrative configurations include, but are not limited to, one, two, three, four or more sections. In some instances, the assemblies may be suitable for use in systems where the pressure may drop from atmospheric pressure (about 760 Torr) down to $10^{-7}$ Torr or less.

In one aspect, a device comprising a multipole assembly comprising a plurality of poles, in which at least one of the poles of the multipole assembly comprises an integral fluid path that fluidically couples an ion volume formed by the poles of the multipole assembly to an outer volume of the multipole assembly is provided.

In certain embodiments, the poles of the multipole assembly are configured together to transmit ions comprising a selected mass-to-charge ratio. In other embodiments, the pole comprising the integral fluid path comprises a first section comprising a width at a first end of the first section that is less than a width at a second end of the first section. In some instances, the pole comprising the integral fluid path comprises a second section configured to electrically couple to the first section. In some configurations, each of the first section and the second section comprises at least one integral fluid path configured to provide the fluid path between the ion volume formed by the multipole assembly and the outer volume of the multipole assembly to remove fluid from the ion volume to the outer volume. In other embodiments, at least two opposite poles of the multipole assembly are configured with an integral fluid path effective to remove fluid from the ion volume to the outer volume. In some instances, each pole of the multipole assembly is configured with an integral fluid path effective to remove fluid from the ion volume to the outer volume. In other configurations, opposite poles of the multipole assembly comprise an integral fluid path that each comprise a first section comprising a width at a first end of the first section that is less than a width at a second end of the first section. In additional configurations, the opposite poles comprising the integral fluid path each comprise a second section configured to electrically couple to the first section. In some embodiments, each of the first section and the second section of each of the opposite poles comprises an integral fluid path effective to remove fluid from the ion volume to the outer volume. In other instances, the integral fluid path is arranged at a non-orthogonal angle to the ion travel axis of the multipole assembly.

In further embodiments, multipole assembly is configured as a quadrupole assembly. In some configurations, each of first, second, third and fourth poles of the quadrupole assembly comprises an integral fluid path that fluidically couples the ion volume formed by the poles of the quadrupole assembly to an outer volume of the quadrupole assembly. In some instances, each integral fluid path is arranged at a non-orthogonal angle to the ion travel axis of the quadrupole assembly.

In some examples, the multipole assembly is configured as a hexapole assembly. In certain configurations, each of first, second, third, fourth, fifth and sixth poles of the hexapole assembly comprises an integral fluid path that fluidically couples the ion volume formed by the poles of the hexapole assembly to an outer volume of the hexapole assembly. In some instances, each integral fluid path is arranged at a non-orthogonal angle to the ion travel axis of the hexapole assembly.

In certain examples, the multipole assembly is configured as an octupole assembly. In additional embodiments, each of first, second, third, fourth, fifth, sixth, seventh and eighth poles of the octupole assembly comprises an integral fluid path that fluidically couples the ion volume formed by the poles of the octupole assembly to an outer volume of the octupole assembly. In further examples, each integral fluid path is arranged at a non-orthogonal angle to the ion travel axis of the octupole assembly.

In an additional aspect, a mass spectrometer comprising a sample introduction device, an ionization device fluidically coupled to the sample introduction device, a mass analyzer fluidically coupled to the ionization device, the mass analyzer comprising a multipole assembly comprising a plurality of poles, in which at least one of the poles of the multipole assembly comprises an integral fluid path that fluidically couples the ion volume formed by the poles of the multipole assembly to an outer volume of the multipole assembly, and a detector fluidically coupled to the mass analyzer is provided.

In certain examples, the mass spectrometer may comprise at least one pump fluidically coupled to the integral fluid path. In some embodiments, the pole comprising the integral fluid path comprises a first section comprising a width at a first end of the first section that is less than the width at a second end of the first section. In other configurations, the mass spectrometer may comprise an interface between the ionization device and the multipole assembly, in which the first end of the first section of the pole comprising the integral fluid path is configured to insert into the interface. In some embodiments, the interface is configured as a skimmer cone. In other embodiments, at least two opposite poles of the multipole assembly each comprise an integral fluid path that fluidically couples the ion volume formed by the poles of the multipole assembly to an outer volume of the multipole assembly. In further examples, the mass spectrometer may comprise at least one pump fluidically coupled to each of the integral fluid paths. In some embodiments, opposites poles comprising the integral fluid path comprise a first section comprising a width at first end of the first section that is less than a width at a second end of the first section. In some instances, the first end of each of the opposite poles is configured to insert into an interface, e.g., a skimmer cone. In some embodiments, the integral fluid path is arranged at a non-orthogonal angle to an ion travel axis of the multipole assembly.

In some configurations, the multipole assembly of the mass spectrometer is configured as a quadrupole assembly. In certain instances, each of first, second, third and fourth poles of the quadrupole assembly comprises an integral fluid path that fluidically couples the ion volume formed by the poles of the quadrupole assembly to an outer volume of the quadrupole assembly. In other instances, each integral fluid path is arranged at a non-orthogonal angle to the ion travel axis of the quadrupole assembly.

In other configurations, the multipole assembly of the mass spectrometer is configured as a hexapole assembly. In some embodiments, each of first, second, third, fourth, fifth and sixth poles of the hexapole assembly comprises an integral fluid path that fluidically couples the ion volume formed by the poles of the hexapole assembly to an outer volume of the hexapole assembly. In other embodiments, each integral fluid path is arranged at a non-orthogonal angle to the ion travel axis of the hexapole assembly.

In additional configurations, the multipole assembly of the mass spectrometer is configured as an octupole assembly. In some embodiments, each of first, second, third, fourth, fifth, sixth, seventh and eighth poles of the octupole assembly comprises an integral fluid path that fluidically couples the ion volume formed by the poles of the octupole assembly to an outer volume of the octupole assembly. In other embodiments, each integral fluid path is arranged at a non-orthogonal angle to the ion travel axis of the octupole assembly.

In another aspect, a device configured to transmit ions based on mass-to-charge ratio, the device comprising a rod assembly comprising a plurality of poles, in which at least one pole of the plurality of poles comprises a rod comprising an integral fluid path configured to fluidically couple an ion volume formed by the rod assembly to an outer volume of the rod assembly to remove fluid within the ion volume to the outer volume is provided.

In certain configurations, the integral fluid path is configured as at least one hole/slot pair that provides fluidic coupling between the ion volume and the outer volume. In other configurations, the slot is arranged at a non-orthogonal angle to the ion travel axis of the assembly. In some embodiments, the integral fluid path is configured as at least one non-orthogonal serration that provides fluidic coupling between the ion volume and the outer volume. In some examples, the integral fluid path comprises a plurality of non-orthogonal serrations each providing fluidic coupling between the ion volume and the outer volume. In additional examples, at least one rod of the rod assembly comprises a first section and a second section. In some embodiments, each of the first section and the second section comprises an integral fluid path configured to fluidically couple an ion volume formed by the rod assembly to an outer volume of the rod assembly to remove fluid within the ion volume to the outer volume. In some instances, the rod assembly comprises four rods constructed and arranged to provide a quadrupole assembly. In other instances, the rod assembly comprises six rods constructed and arranged to provide a hexapole assembly. In additional configurations, the rod assembly comprises eight rods constructed and arranged to provide an octupole assembly.

In another aspect, a method of reducing the pressure in a mass spectrometer stage, the method comprising providing at least one rod configured to form a rod assembly with a plurality of additional rods to provide a plurality of poles, the at least one rod comprising at least one integral fluid path configured to fluidically couple an ion volume formed by the rod assembly to an outer volume of the rod assembly to remove fluid within the ion volume to the outer volume is disclosed.

In certain embodiments, the method may comprise fluidically coupling a pump to the integral fluid path to reduce the pressure in the mass spectrometer stage. In other instances, the method may comprise configuring the rod with a plurality of integral fluid paths. In certain embodiments, at least two of integral fluid paths are sized and arranged to be different. In other embodiments, the rod assembly is configured as a quadrupole rod assembly, a hexapole rod assembly or an octupole rod assembly. In some configurations, the method may comprise configuring each rod of the rod assembly to comprise an integral fluid path configured to fluidically couple an ion volume formed by the rod assembly to an outer volume of the rod assembly to remove fluid within the ion volume to the outer volume.

In an additional aspect, a kit comprising a rod for use in a rod assembly, the rod comprising at least one integral fluid path configured to fluidically couple an ion volume formed by the rod in the rod assembly to an outer volume of the rod assembly to remove fluid within the ion volume to the outer volume, and instructions for using the rod to assemble the rod assembly is provided.

In certain configurations, the instructions of the kit are configured to assemble a quadrupole rod assembly using the rod, a hexapole rod assembly using the rod or an octupole rod assembly using the rod. In some embodiments, the kit may comprise a second rod comprising at least one integral fluid path configured to fluidically couple an ion volume formed by the rod assembly to an outer volume of the rod assembly to remove fluid within the ion volume to the outer volume. In certain instances, the kit may comprise a plurality of rods each comprising at least one integral fluid path configured to fluidically couple an ion volume formed by the rod assembly to an outer volume of the rod assembly to remove fluid within the ion volume to the outer volume. In some embodiments, the rod(s) of the kit may be configured as a first section and a second section separate from the first section and configured to electrically couple to the first section. In some instances, the first section comprises the integral fluid path, whereas in other configurations each of the first section and the second section comprise an integral fluid path. In some embodiments, the kit may comprise a plurality of rods, in which each rod comprises a first section and a second section separate from the first section and configured to electrically couple to the first section, in which the first section of each of the rods comprises at least one integral fluid path configured to fluidically couple an ion volume formed by the rod assembly to an outer volume of the rod assembly to remove fluid within the ion volume to the outer volume. In some configurations, the second section of each of the plurality of rods comprises at least one integral fluid path configured to fluidically couple an ion volume formed by the rod assembly to an outer volume of the rod assembly to remove fluid within the ion volume to the outer volume.

Additional features, aspect, examples and embodiments are described in more detail below.

BRIEF DESCRIPTION OF THE FIGURES

Certain embodiments of the devices and systems are described with reference to the accompanying figures in which.

Figure 1:
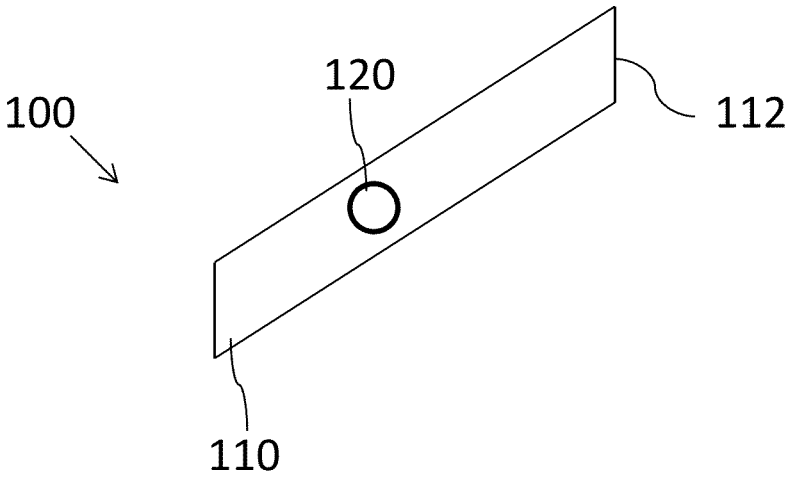
FIG. 1 is a side view of a rod comprising a plurality of holes or apertures in the body of the rod, in accordance with certain configurations.

It will be recognized by the person of ordinary skill in the art, given the benefit of this disclosure, that certain dimensions or features of the components of the systems may have been enlarged, distorted or shown in an otherwise unconventional or non proportional manner to provide a more user friendly version of the figures. In addition, the exact length, width, geometry, aperture size, etc. of the rods and other components described herein may vary.

DETAILED DESCRIPTION

Certain embodiments are described below with reference to singular and plural terms in order to provide a user friendly description of the technology disclosed herein. These terms are used for convenience purposes only and are not intended to limit the devices, methods and systems described herein.

In certain configurations, RF ion guides can be used to focus ions within a selected mass range. Where atmospheric pressure ionization (API) is used, atmospheric gas including charged molecules, e.g. ions, are sampled. While the exact system for such sampling may vary, and illustrative systems are described below, the system may include one, two, three or more vacuum stages. There may exist interfaces between gas stages to facilitate transfer of species from one stage to another. For example, a first gas restrictor may be present to permit gas to exit from a first stage. A sampling cone or sampling device may be present to separate the species based on momentum and to pump away the lighter species while maintaining the larger particles and ions. Behind the sampling cone, high pressure ion guides can be used to focus the ions into the center of the ion guide while pumping away any unwanted gas. Pressure may be reduced further using one or more additional vacuum stages to reach a desired mass analyzer pressure. Certain embodiments described herein are directed to devices, systems and methods that can result in a substantial pressure drop between the first and second vacuum stages (or between any two vacuum stages) and can select or transmit ions. The open nature of the rods and rod assemblies described herein permits a rapid pressure drop while at the same time maintaining suitable fields for ion guiding and/or transmission. In some configurations, the rods can be configured to have an integral fluid path to maximize gas conductance while still maintaining the RF fields to permit proper ion guidance and/or transmission.

While certain configurations are described below that show a plurality of serrations or slots configured as a fluid path that provides fluidic coupling between an ion volume and an outer volume, only a single fluid path, e.g., one serration, one slot, one hole/slot pair, etc. may be present if desired. For example, a pole section of the multipole assembly may comprise a generally solid body that can function as one pole of the multipole assembly with a single fluid path that provides fluidic coupling between the inside region of the assembly, e.g., the ion volume, and the outside region of the assembly, e.g., the outer volume. One or more pumps or other devices may be fluidically coupled to the outer volume such that fluid, e.g., gas, may flow from the ion volume, through the fluid path and the outer volume and be removed through the pump. Certain sections of the multipole assembly may be sealed or otherwise not include any integral fluid paths to minimize or eliminate gas flow from the ion volume to the outer volume at those sections. For example, sections which are closer to an interface such as a skimmer cone may comprise one or more fluid paths to drop the pressure in the multipole assembly, whereas downstream sections further away from the skimmer cone may have a sufficiently low pressure such that no or little gas conductance from the ion volume to the outer volume is needed at those sections. As gas is removed at sections comprising the integral fluid path(s), the poles are desirably configured to contain the ions within the ion volume and guide and/or filter the ions using the fields sustained with the poles. In some configurations, one or more sections may be configured to provide a rapid decrease in pressure in a minimal longitudinal length along the section.

In some instances, the various sections of the multipole assemblies described herein may be electrically isolated from each other so that different fields may exist in different sections. Similarly, the size and/or shape of the ion volume may be different at different sections of the multipole assembly. Different sections may also comprise a different number of poles, if desired, e.g., a quadrupole in one section and a hexapole in another section.

In certain configurations, one or more pumps may be fluidically coupled the outer volume of the multipole assembly. In some instances, a single pump can be used, but different sections of the multipole assembly may be pumped at different speeds to provide a desired gas conductance at each section. In other configurations, two or more pumps may be present with each pump fluidically coupled to a respective section. Depending on the number of integral fluid paths present in a particular section and the desired pressure drop, the exact speed at which the pump is operated may vary. In some embodiments, a single turbopump may be fluidically coupled to the multipole assembly. For example, the turbopump or turbomolecular pump may comprise a plurality of stages any one or more of which can be fluidically coupled to the outer volume to pump gas out of the multipole assembly. In some instances, the pump may be present as a component of a larger system, e.g., a mass spectrometer, and may be used to provide reduced pressure, e.g., a vacuum, at other areas of the system. In some instances, a pump stage with a higher pumping speed (or volume) may be fluidically coupled to an outer volume of a first multipole section adjacent to an interface, e.g., a skimmer come, and a pump stage with a lower pumping speed (or volume) may be fluidically coupled to an outer volume of a multipole section that is downstream of the first multipole section. As noted below, discs or other suitable components may separate the various multipole sections to isolate each section from other sections.

In some configurations, the overall size of the ion volume and/or spacing of the poles may vary depending on the desired gas conductance. As described in more detail below, the size of the ion volume can be altered or selected using inserts such as insulator shims, e.g., ceramic shims or inert material shims, to reduce the overall conductance. Without wishing to be bound by any particular scientific theory, where a large gas conductance is desired the ion volume and/or spacing between poles may be larger than where a smaller gas conductance is desired. Similarly, different cross-sectional shapes of the ion volume may provide for different gas conductances. In some embodiments, the ion volume may have a diameter, length or width of about 38 mm, for example, about 4-6 mm or about 4.5-5.5 mm. The spacing between poles may vary between about 0.5 mm to about 4 mm, more particularly about 1 mm to about 2 mm. The exact shape and/or dimension of the poles may vary and in some instances, the structures that provide the poles are square, circular, hexagonal, or may take other shapes.

In certain embodiments and referring to FIG. 1, an illustration of one rod of a rod assembly structure is shown. The rod 100 is generally operative as one pole in a multipole rod assembly. The rod 100 comprises a solid body 110 comprising an integral fluid path, which is configured as a hole 120 in the body 110, though a plurality of holes or apertures in the body 110 may also be present or as discussed below a hole/slot pair or a plurality of hole/slot pairs may be present in the body 110. The term "slot" may be interchanged in certain instances herein with the term "serration." The rod 100 may be arranged in a desired manner with other rods to provide a quadrupole, hexapole, octupole or other structure with a desired numbers of poles, e.g., a structure with an even number of rods, that can be used to select and/or guide ions. In some embodiments, each rod of the structure may be the same, whereas in different configurations, two rods may be the same or two rods may be different. In some embodiments, even though different types of rods may be present, configurations that provide for a symmetric arrangement of rods can be implemented. The hole 120 present in the rod 100 is sized and arranged to provide a fluid path between inner space or ion volume of the rod assembly and outer space or outer volume of the rod assembly. The inner space or ion volume is the area of the assembly where ions travel, e.g., the ion path region, and the outer space or outer volume is the space surrounding the rod assembly, e.g., the non-ion path region. To permit removal of gas from the ion volume, the fluid path may fluidically couple the ion volume to the outer volume so gas can be rapidly removed from the ion volume. In many existing configurations, the small gap between rod pairs is the only accessible space to pump out gas. The hole 120 provides a fluid path where gas may be pumped out of the system, which permits the use of cheaper and lesser efficient pumps while at the same time providing a sharper pressure drop than can be achieved where only rod gaps are used to remove gas. By including one or more integral fluid paths in the rod, a vacuum open structure is provided that can be used to rapidly drop the pressure from the high pressure (e.g., greater than 1 Torr used to introduce the sample) to a low pressure, e.g., the pressure can be reduced rapidly to $10^{-3}$ or $10^{-4}$ Torr at the front of the rod assembly. In some configurations, the rod body 110 comprises a first end 112 and a second end 114. The first end 112 can be placed against a skimmer or sampling cone (or other interface) and may be sized and arranged suitably to position one of the ends 112, 114 of the rod 100 as close as possible to the skimmer cone. Illustrations of such configurations are described below.

Figure 2:
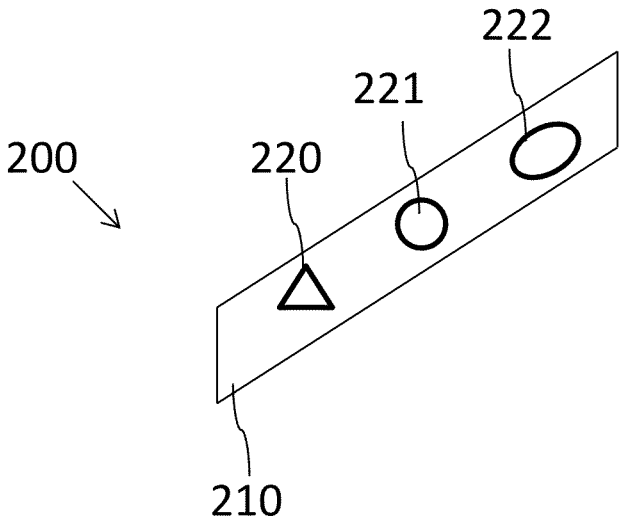
FIG. 2 is a side of a rod comprising a plurality of differently sized holes or apertures in the body of the rod, in accordance with certain configurations.

In certain examples, the integral fluid path present in the rod may be sized and arranged in many different manners. For example and referring to FIG. 2, a rod 200 is shown that comprises three apertures 220-222 in a body 210. For illustration purposes, the apertures 220-222 are shown as having different shapes, but if desired, two of the apertures may have the same cross-sectional shape. In some embodiments, the cross-sectional shape for the aperture may be rounded, e.g., similar to apertures 221 or 222 to provide better flow of gas through the rod 200. The particular hole spacing may vary depending on the desired gas flow and pressure drop. In some embodiments, the holes may be positioned so that more holes are positioned more closely to the end of the rod closest to the skimmer or interface. In other configurations, the holes may be positioned so that more holes are positioned further away from the end of the rod closest to the skimmer or interface. In some instances, the holes may be spaced similarly along the length of the rod and the hole size and/or shape may be the same or may be different. In some instances, a rod assembly may comprise a plurality of rods where two or more of the rods comprise holes which are sized and arranged differently. In some embodiments, opposite poles of a rod assembly may comprise holes sized and arranged similar to each other.

Figure 3:
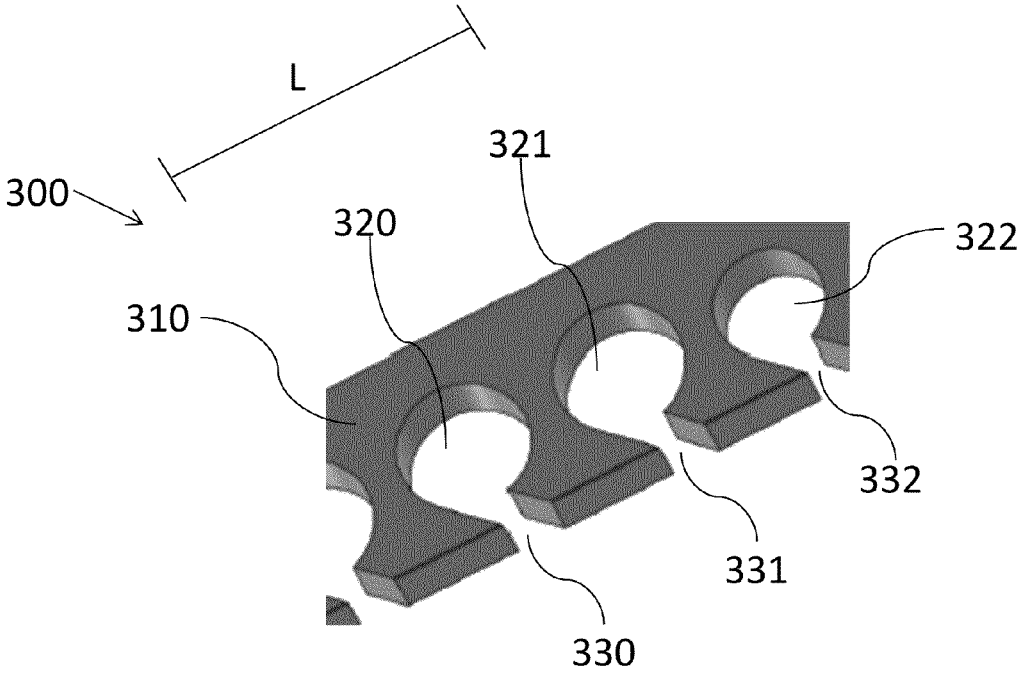
FIG. 3 is a side view of a rod comprising hole/slot pairs in the body of the rod, in accordance with certain configurations.

In certain embodiments, the rods may include one or more slots, serrations or grooves that are arranged at an angle to the longitudinal axis of the rod body. Referring to FIG. 3, a rod 300 comprises a body 310 comprising a plurality of apertures 320-322 each comprising a respective slot or serration 330-332. Together the apertures or holes 320-322 and slots 330-332 provide a hole/slot pair. The slots 330-332 generally have a smaller diameter than the holes 320-322 and provide fluidic coupling between the ion volume formed by the rod assembly and the holes 320-322. For example, the slots 330-332 provide a fluid path between the ion volume underneath the rod 300 so gas can be removed from underneath the rod 300 and provided to the outer volume and pumped out of the system to reduce the pressure quickly at the front of the rod assembly near the sampling interface. Gas or fluid may flow from the ion volume formed by the rod assembly, through the slots 330-332 and onto the holes 320-322. A vacuum pump (not shown) may be fluidically coupled to the holes 320-322 to draw gas from the ion volume formed by the rods. In FIG. 3, the slots 330-332 are shown as being angled acutely (or angled away from the end of the rod closest to the skimmer cone or other interface) with respect to the longitudinal axis L of the body 310. If desired, however, the slots may be orthogonal to the longitudinal axis L, also referred to herein as an ion travel path or ion travel axis, may be non-orthogonal to the longitudinal axis L, may be obtuse to the longitudinal axis L, e.g., angled toward the end of the rod closest to the skimmer cone or other interface or may take other forms or angles. In some embodiments, different slots are angled differently to provide a desired fluid flow out of the ion volume. In some instances, the angle of the slots may be the same, but the diameter of certain slots may be different from the diameter of other slots to provide a desired fluid flow. In embodiments where the rods are used in a quadrupole, hexapole or octupole, the rods may be sized and arranged similarly but their arrangement in the quadrupole can provide for some slots which are acutely angled and for other slots that are obtusely angled. For example, if four similar rods comprising hole/slot pairs with acutely angled slots are used to produce a quadrupole rod assembly, some of the slots will be angled acutely in the quadrupole rod assembly and other slots will be angled obtusely in the quadrupole rod assembly. Similarly, the holes 320-322 may be sized the same or may be different as described, for example, in reference to FIGS. 1 and 2. In some embodiments, it may be desirable to include slots in certain holes and have other holes present without a corresponding slot. By selecting the shape of the holes and slots and/or the orientation of the slots, the fluid flow within the system can be better controlled. In some instances, each of the slots may be angled substantially the same to provide for a more symmetric RF field along the rod, e.g., to maintain the containment electrical fields.

Figure 4:
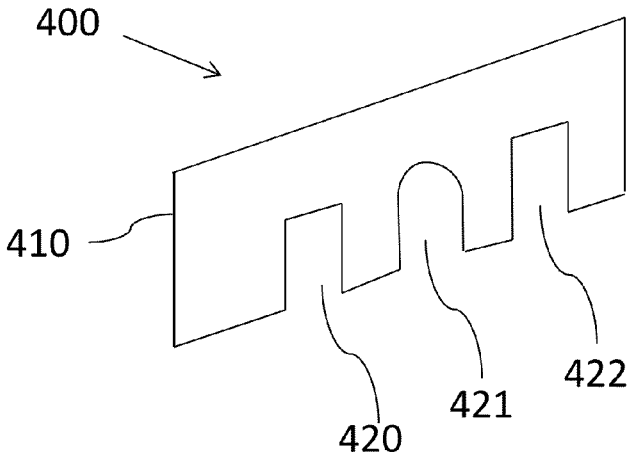
FIG. 4 is a side view of a rod comprising slots, in accordance with certain configurations.

In certain configurations, the holes of the rods may be omitted and the slots may be sized and arranged to extend into the body of the rod to provide an integral fluid path in the rod. For example and referring to FIG. 4, a rod 400 is shown comprising a plurality of serrations or slots 420-422 extending into the body 410 of the rod 400. The slots 420-422 may be sized and arranged the same or may be different, e.g., slots 420 and 421 are sized to be different in FIG. 4. The length of the slots can be selected to be long enough to extend into the body 410 so a pump can be fluidically coupled to inner space formed by the rod assembly and draw gas from the inner space through the fluid path formed by the slots 420-422 and out of the system or stage. The width of the slots 420-422 may be the same or different, and the width of each slot 420-422 may vary. In some instances, the width of the slot closer to the ion volume is less than the width of the slot closer to the outer volume. By arranging the width of the slot closer to the ion volume to be smaller, more uniform electric fields may be sustained.

Figure 5A:
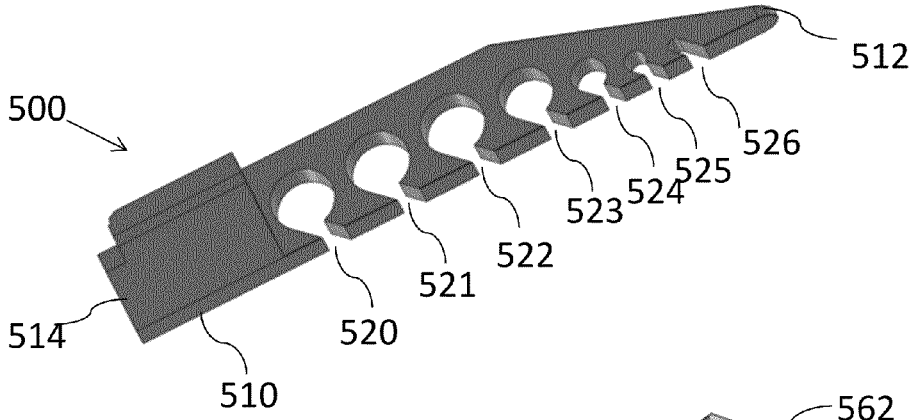
FIG. 5A is a side view of a first rod section comprising hole/slot pairs and a tapered end, in accordance with certain configurations.
Figure 5B:
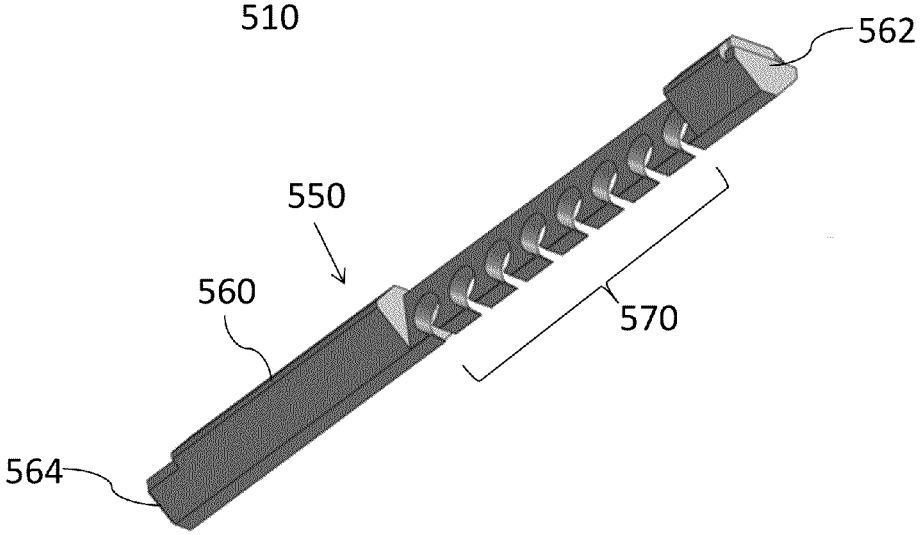
FIG. 5B is a side view of a second rod section comprising hole/slot pairs, in accordance with certain configurations.

In certain examples, the rods described herein may be segmented or broken into a plurality of individual rods or sections which can be electrically coupled to each other through a suitable interface. For example, one of the rods can be split into a first or front section and a second or back section. The two sections can be electrically coupled to each other to provide a desired field when the sections are part of a rod assembly. If desired, the sections may function differently depending on the overall configuration. Referring to FIGS. 5A and 5B, illustrations of a first section 500 and a second section 550 are shown. The first section 500 comprises a body 510 with a first end 512 and a second end 514 and a plurality of slots 520-526. The end 512 is tapered so that its width at the first end 512 is generally less than the width at the second end 514. The tapered end 512 is sized and arranged so it can be placed close to the sampling cone (not shown) or other interface. As described in more detail below, the end 512 of the first section 500 may be inserted into the sampling cone (or other interface) to position an entrance aperture of the rod assembly closer to the interface. In the configuration shown in FIG. 5A, the size of the fluid paths 520-526 generally decrease from the fluid path 520 to the fluid path 526 as the width of the body 510 decreases toward the end 512. As described herein, the integral fluid paths 520-526 can be configured to provide a fluid path between a pump and ion volume formed by positioning of the rods of the rod assembly to remove gas from the ion volume and reduce the overall pressure in the system (or in the particular stage where the rod is present). Referring to FIG. 5B, an illustration of a second or back section 550 is shown. The second section 550 comprises a body 560 comprising a first end 562 and a second end 564. Between the ends 562, 564 is a segment that includes a plurality of fluid paths, which are grouped together as element 570 for ease of illustration. The fluid paths 570 are configured to provide a fluid path between the ion volume formed by the rod assembly and a pump to reduce the pressure within the system or stage where the second sections are present.

In certain examples, the second section 550 may electrically couple to the front section 500 to provide an electrical connection between the two different sections. For example, the end 562 of the back section 550 may be placed adjacent to the end 514 of the front section 500 to provide an electrical connection between the two sections 500, 550. If desired one or more interfaces may be present between the sections 500, 550. In some embodiments, the first section 500 and the second section 550 may be separated by one or more mounting blocks or discs configured to hold the various sections at a desired position to provide a selected rod assembly. The discs may also serve to isolate the various sections from each other, e.g., electrically isolate them or isolate the gas conductance of one section from another section or both. In certain instances, the different sections of a rod may be configured to provide different functions if desired. For example, the front section 500 may be designed as a space charge section and the back section 550 may be configured as an ion transport section. The space charge effect results as charged species interact with each other, e.g., ion-ion repulsion of particles with like charge. As new ions arrive at an interface, they newly arrived ions repel ions already present at the interface and push the ions forward. Ions can be initially selected in the front section 500 and then provided to the ion transport section 550 to provide the selected ions through the rod assembly and to another stage or to a detector. If desired, the ion transport section 550 may provide additional mass filtering/selection to select or transmit ions having a desired mass-to-charge ratio.

Figure 6A:
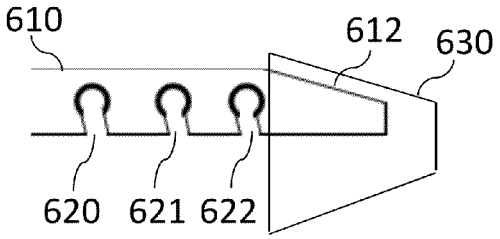
FIGS. 6A-6D show various configurations of ends of a first rod section, in accordance with certain configurations.
Figure 6B:
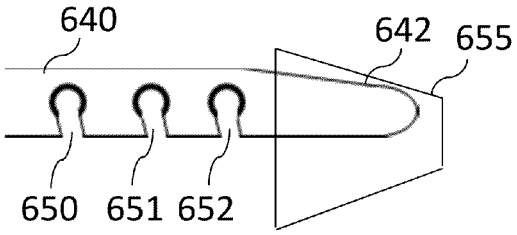

In certain examples, the exact cross-sectional shape of the end of the first section that can be positioned adjacent to a sampling interface such as a skimmer cone may vary. Referring to FIGS. 6A-6D, various shapes are shown which permit insertion of the first section into the sampling interface. The shapes generally impart a width at one end of the rod (or rod section) that is less than the width at an opposite side of the rod (or rod section). For reference purposes, a skimmer cone is shown as being present in each of FIGS. 6A-6D, though other suitable interfaces can be used. A sampling interface generally receives ions from an ionization source, which is often a high temperature plasma operated at atmospheric pressure. As ions enter a first sampling interface, ions within the center may pass through a first sampling interface, which is typically held at a pressure of about 1-3 Torr through the use of a vacuum pump. If desired, the ions may then be provided to a second sampling interface and onto the rod assembly, which is typically held at a pressure of about $10^{-3}$ to $10^{-4}$ Torr. Without wishing to be bound by any particular scientific theory, ions exiting the skimmer cone generally follow the gas flow and not the electric or magnetic fields in the entrance of any ion guides. As pressure decreases, the RF fields of the ion guides start to control the path of the ions. The rod sections described herein may be placed directly against the back side of the second sampling interface (or the first sampling interface where a second sampling interface is omitted) so ions can enter into the rod assembly. The fluid path provided by the rods of the rod assembly can quickly remove gas, e.g., Argon, to reduce the pressure of the stage. If desired, one or more lenses can be present between the rod assembly and the sampling interface to provide for additional ion focusing prior to entry into the rod assembly for mass filtering. Referring to FIG. 6A, an end 612 of a rod section 610 is shown as being inserted into a skimmer cone 630. By inserting the end 612 closer to the back side of the skimmer cone 630, the trajectory of ions passing through the skimmer cone 630 does not substantially change prior to entering into the aperture of the rod assembly. Lenses may be omitted between the rod section 610 and the skimmer cone 630 to simplify the overall system setup. The rod 610 is shown as including three integral fluid paths, e.g., hole/slot pairs, 620-622 though fewer or more fluid paths may be included. In addition, one or more of the fluid paths may be inserted into the skimmer cone 630 or the fluid paths may all reside outside the skimmer cone 630.

Figure 6C:
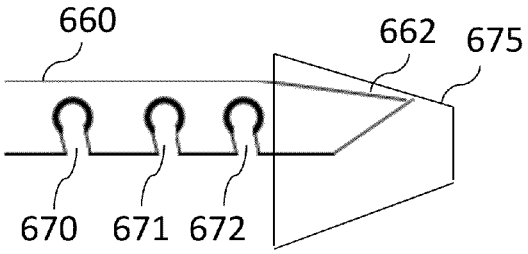
Figure 6D:
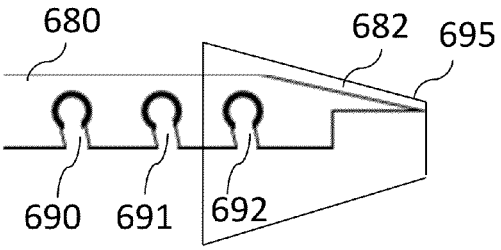

In certain embodiments, the shape of the ends of the rods may vary and different rods within a rod assembly may comprise ends with different shapes. For example and referring to FIG. 6B, a rod 640 is shown comprising fluid paths 650-652 and a rounded end 642 that can be inserted into a skimmer cone 655. Referring to FIG. 6C, a rod 660 is shown comprising fluid paths 670-672 and an outwardly projecting triangular end 662 that can be inserted into a skimmer cone 675. Referring to FIG. 6D, a rod 680 is shown comprising fluid paths 690-692 and an inwardly projecting triangular end 682 that can be inserted into a skimmer cone 695. While the skimmer cones 630, 655, 675 and 695 are shown for illustration purposes, rod and rod assemblies which are not inserted into skimmer cones may take shapes similar to the rods 610, 640, 660 and 680 and additional suitable rod end shapes will be readily selected by the person of ordinary skill in the art, given the benefit of this disclosure.

Figure 7:
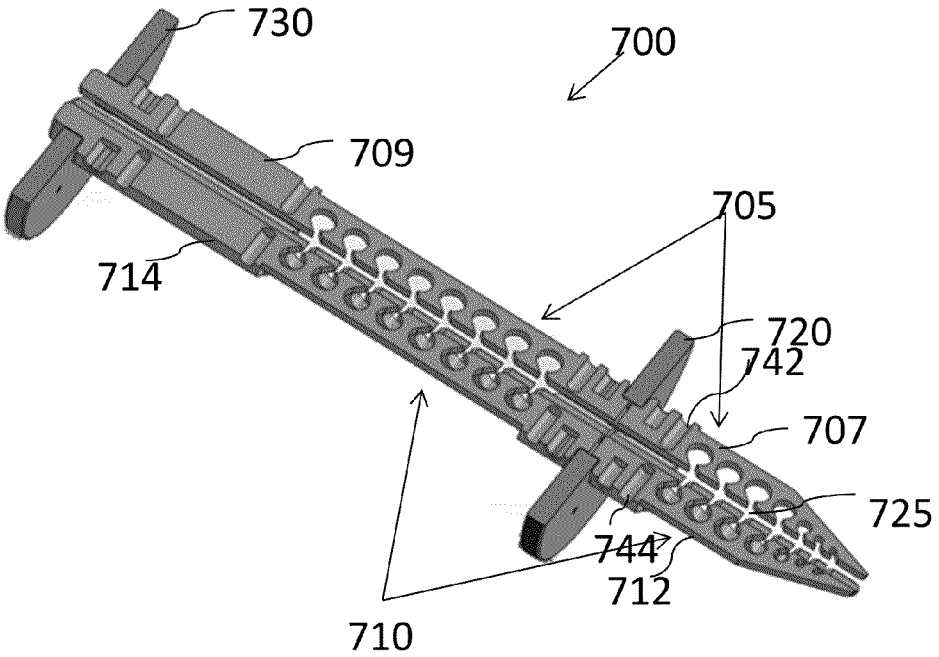
FIG. 7 shows two rods of a rod assembly, in accordance with certain examples.

In certain examples, the rod sections described herein may be part of a larger rod assembly comprising a plurality of rods that are operative as poles. Referring to FIG. 7, a cross-section of a rod assembly 700 showing two rods 705 and 710 is illustrated. The first rod 705 comprises a first section 707 and a second section 709. The second rod 710 comprises a first section 712 and a second section 714. Each of the rod sections 707, 709, 712 and 714 comprise a plurality of integral fluid paths. Separating the first section 707 and the second section 709 is a disc 720 which may serve, for example, as a mount for the first section 707 and/or may occupy space within a system to prevent gas flow around the outside of the rod assembly. The disc 720 may be made of many different materials including, for example, ceramics, stainless steel or other materials. Desirably, the material in the disc is inert. In some configurations, the disc 720 may isolate each rod section from the other rod sections of a particular rod. By isolating such sections, the field and/or pressure within the various sections can be individually selected, e.g., the gas conductance in each of the sections may be different. The rods 705, 710 are each operative as one pole of a multipole structure. For example, where 4 rods are present a quadrupole is formed. Where six rods are present, a hexapole is formed. Where eight rods are present, an octupole is formed. In some instances, four rods may be present at one side of the disc 720 and more than four rods may be present on the other side of the disc 720, e.g., a quadrupole-hexapole, quadrupole-octupole or other arrangement of unequal rods may be present. The first section 707 and the second section 709 are electrically coupled and may also physically contact each other. Similarly, the first section 712 and the second section 714 are electrically coupled and may physically contact each other. The rods 705, 710 together can be are used to create a field free region that can reduce the ions needed to space charge the ion guide volume and reduce the number of ions used to push other ions. The open structure of the rods provided by the fluid paths can be used to create a vacuum open structure to remove gas from the system in a rapid manner. In some embodiments, the fluid paths are constructed and arranged to provide an open rod structure that permits rapid removal of gas from the ion volume. The fluid paths may be sized to be as large as possible while still maintaining a desired field in the assembly. One or more fittings or couplings 742, 744 may be present to provide an electrical connection between a power source and the rods 705, 710. If desired, the voltages applied to the first sections 707, 712 may be different from the voltages applies to the second sections 709, 714 to impart different functionality to different sections of the rod assembly. For example, the voltage applied to the sections 707, 712 may be effective to provide space charge effect separation in the first sections 707, 712, and the voltage applied in the second sections 709, 714 may be effective to provide ion guiding using the second sections 709, 714.

In some configurations, the spacing between the two sections of a particular rod may be altered to change the voltage between the two sections. For example, the rods 705, 710 may be spaced apart a suitable distance to form an inner space or ion volume 725 between the rods 705, 710. While the spacing of the fluid paths in the various sections of the rod assembly 700 are shown as being substantially the same, unequal spacing may be implemented if desired. In addition, the different fluid paths may have different shapes and different angles as desired. An additional disc 730 may be present to seal the second sections 709, 714 from the surrounding components of the system such that gas is removed from the ion volume 725 through the hole/slot pairs of the second sections.

Figure 8:
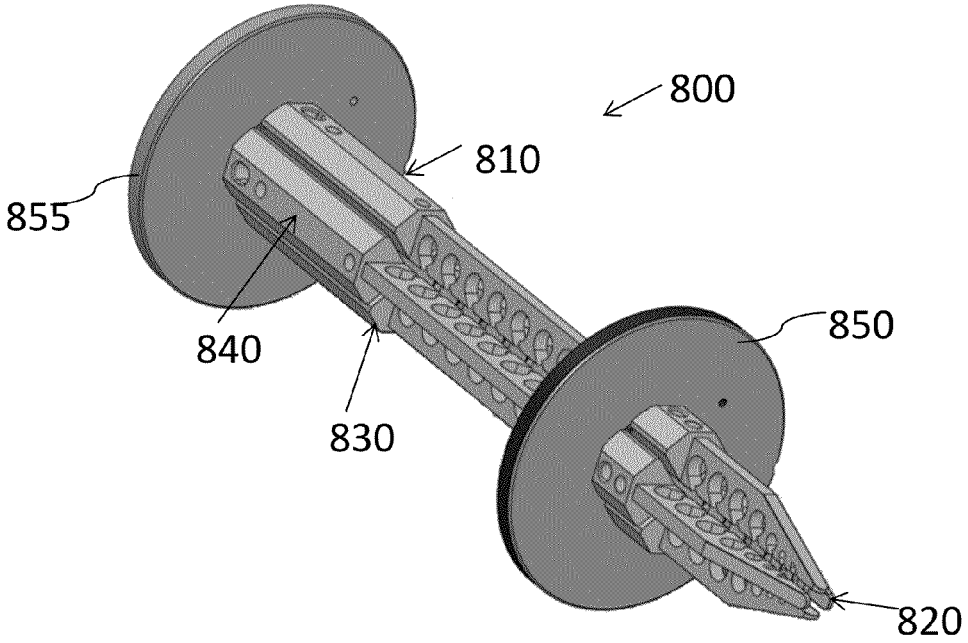
FIG. 8 shows four rods of a quadrupole rod assembly, in accordance with certain configurations.

In certain embodiments, the rod assembly may comprise 4 rods. At least one rod may comprise a body comprising at least one integral fluid flow path configured to provide fluidic coupling between the ion volume and outer volume to remove fluid, e.g. gas, from within the ion volume. In some instances, two of the four rods may each comprise an integral fluid flow path. In additional configurations, three of the four rods may each comprise an in integral fluid flow path. In some embodiments, each of the four rods may each comprise an in integral fluid flow path. For illustration purposes, a quadrupole rod assembly comprising four rods each of which comprises a plurality of integral fluid flow paths, e.g., hole/slot pairs, is shown in FIG. 8. The assembly 800 comprises rods 810, 820, 830 and 840. The rods are positioned in a generally rectangular arrangement to provide a quadrupolar field. The quadrupolar field is arranged to guide ions through the assembly. A field free region (the regions where the path of the ions) may exist where no electric or magnetic fields are present. The rods described herein may be sized and arranged such that the field free region created in the ion volume formed by the rods can be substantially smaller in diameter than a field free region that is present using conventional solid rods in a quadrupole assembly. As described in reference to FIGS. 6 and 7, the rods 810-840 may be present in sections, e.g., a first section and a second section that can electrically couple to the first section. The first section may be tapered or chamfered with a width at one end less than a width at the other end to position the assembly 800 within some portion of a sampling interface, e.g., within a skimmer cone. The assembly 800 may further include a disc 850 between the first and second sections of each rod and may include a disc 855 at a second end of the second section of each rod. The fluid paths in the rod sections provide fluidic coupling between the ion volume and the outer volume of space surrounding the rod assembly. A pump (not shown) can be fluidically coupled to the outer volume of the rod assembly 800 to draw gas out of the ion volume, through the integral fluid paths of the rods 810-840 and to the outer volume.

Figure 9A:
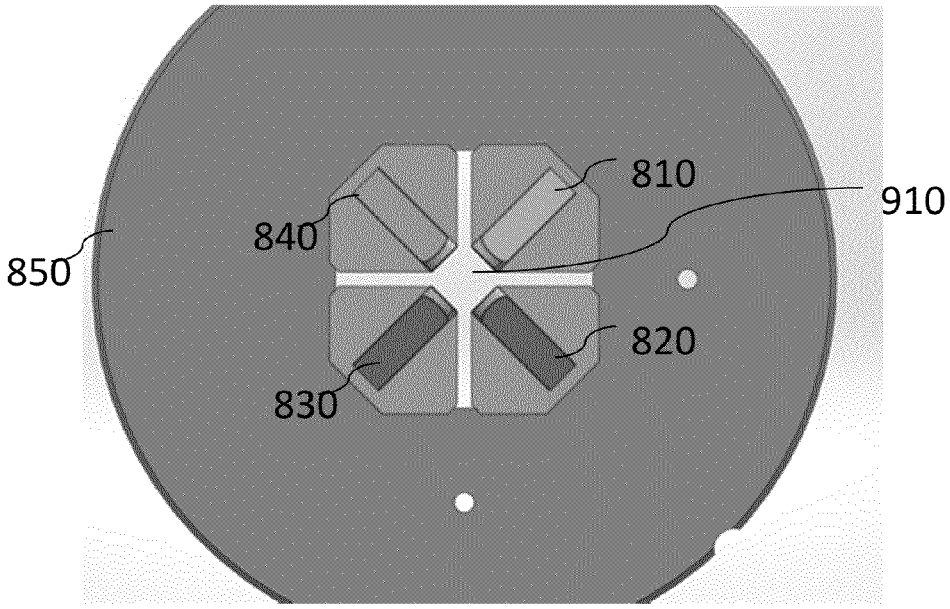
FIG. 9A shows an end view of the quadrupole rod assembly of FIG. 8, in accordance with certain embodiments.
Figure 9B:
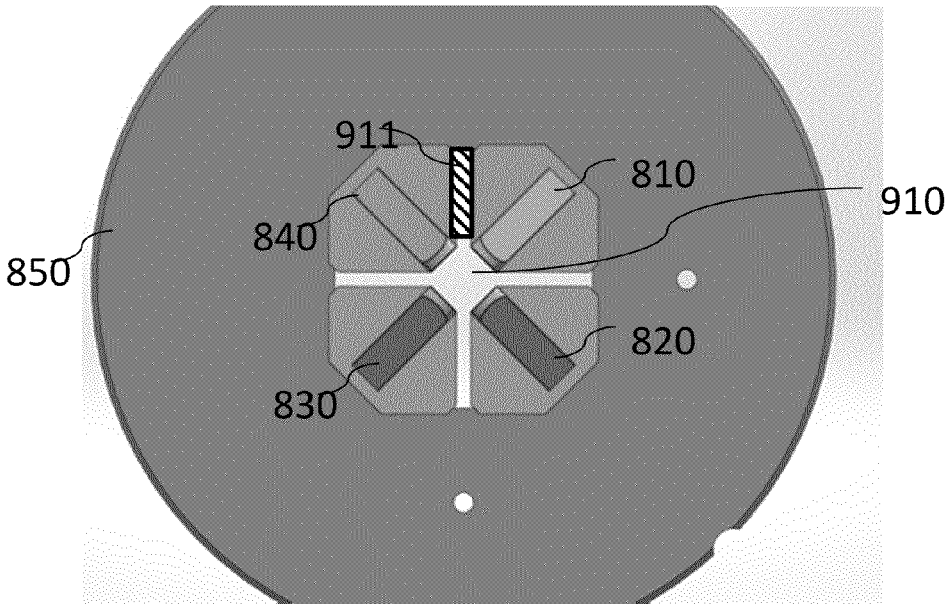
FIGS. 9B-9E show an end view of a quadrupole rod assembly with various numbers of inserts, in accordance with certain examples.
Figure 9C:
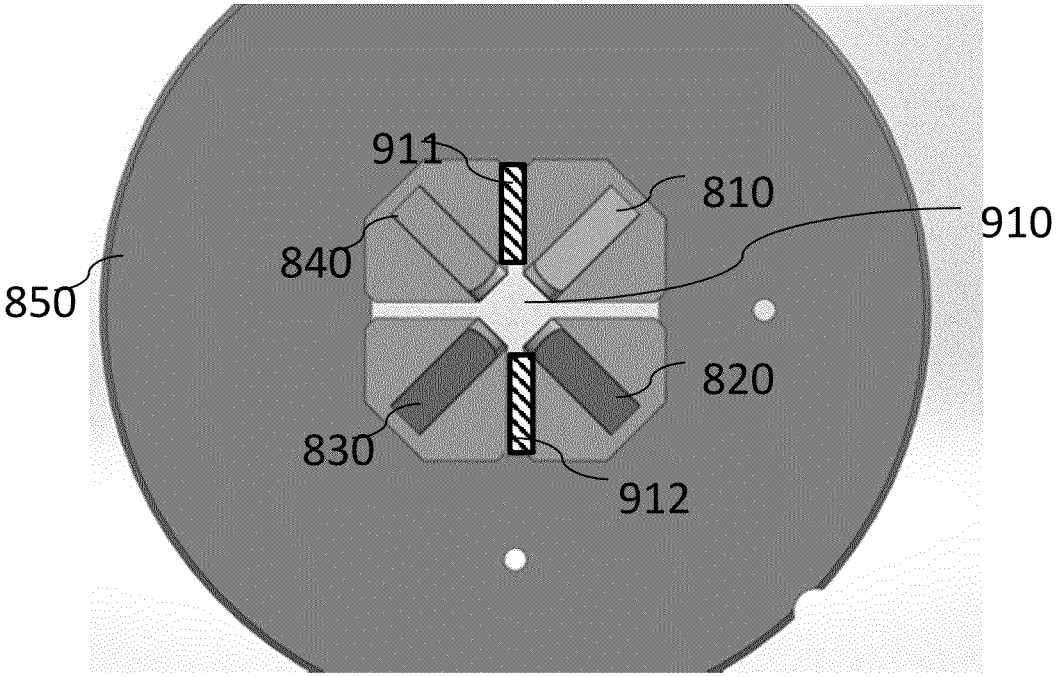
Figure 9D:
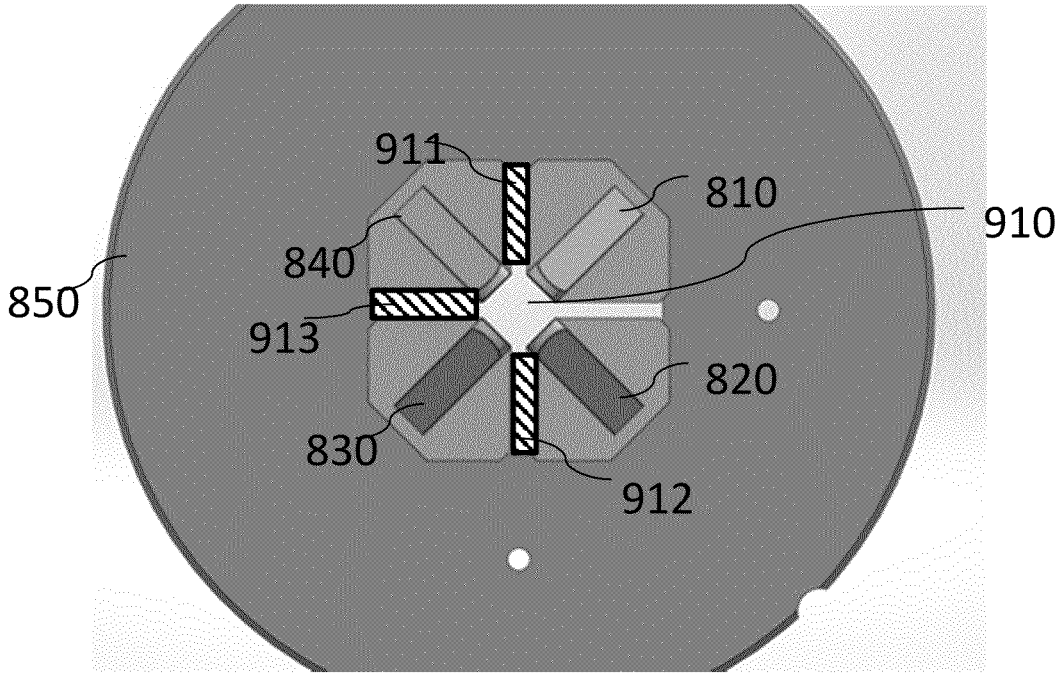
Figure 9E:
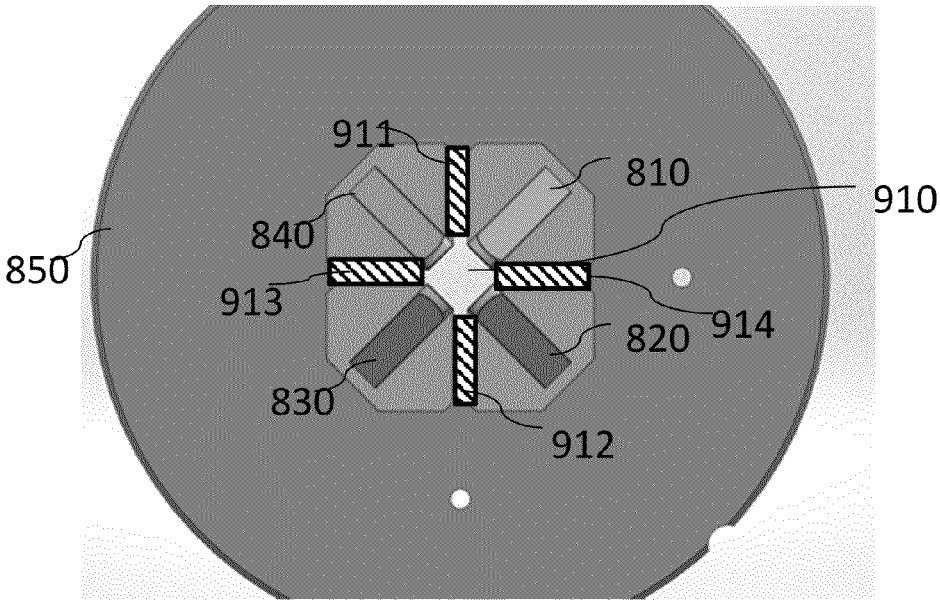

Referring to FIG. 9A, a front view of the rods of FIG. 8 where the first end, e.g., the tapered end, of each rod section is closest to the viewer is shown. An ion volume 910 is formed by positioning the rods 810-840 as shown in FIG. 9A. In some examples, only one of the rods 810-840 may comprise an integral fluid path. In other examples, opposite rods or poles, e.g., rods 810, 830 or rods 820, 840, may each comprise an integral fluid path, e.g., serrations or hole slot/pairs or a plurality of hole/slot pairs. As shown in FIG. 9A, the ion volume 910 formed by positioning the rods 810-840 generally comprises a square cross-section though other shapes may be achieved depending on the particular end shapes of the rods 810-840. If desired, the width, length or diameter of the ion volume 910 formed by first rod sections may be different than the width, length or diameter of the ion volume formed by the second rod sections, e.g., the width of the ion volume 910 may be less than or more than an ion volume formed by the second rod sections. In some instances, the ion volume may generally be square with dimension of about 4-6 mm by about 4-6 mm, e.g., 4.5 mm×4.5 mm. The spacing between different rods may be about 0.5-2 mm, e.g., about 1 mm, even though the spacing may be adjusted by adjustment of the rod positions. The overall size of the ion volume can be altered by using one or more inserts as shown in FIGS. 9B-9E. For example, a single insert 911 can be positioned within the ion volume (FIG. 9B), two inserts 911, 912 can be positioned within the ion volume (FIG. 9C), three inserts 911, 912 and 913 can be positioned within the ion volume (FIG. 9D) or four inserts 911, 912, 913 and 914 can be positioned within the ion volume (FIG. 9E). While symmetry is not required, where two inserts are used, the inserts may be desirably placed opposite of each other as shown in FIG. 9B. The exact materials used for the inserts 911-914 can vary and desirably the inserts are inert and/or insulative. For example, ceramic materials or inert materials that do not react with any ions in the ion volume can be used. In addition, different inserts may be produced using different materials to tune further the electrical fields present in the ion volume.

Figure 10:
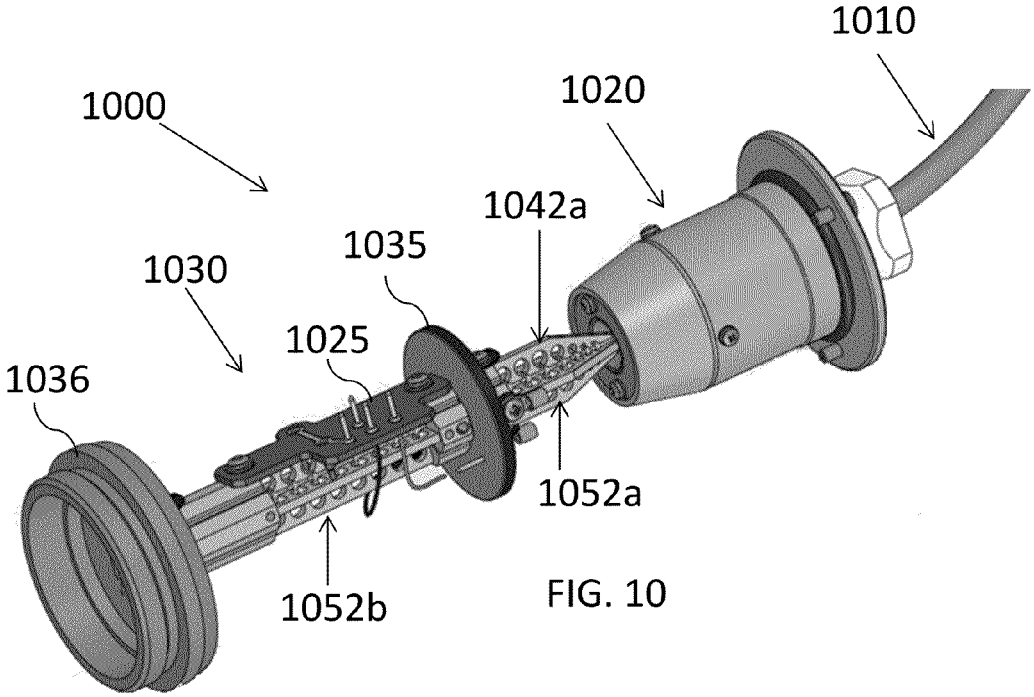
FIG. 10 is an illustration of a quadrupole assembly fluidically coupled to a sampling interface, in accordance with certain examples.

In certain embodiments, the rod assemblies described herein may be present as part of a larger system. Referring to FIG. 10, certain components of a system are shown. The system 1000 generally comprises a fluid path 1010, e.g., a capillary, fluidically coupled to a sampling interface 1020, which is fluidically coupled to a rod assembly 1030 comprising at least one rod as described herein, e.g., a rod comprising an integral fluid path. A board or other interconnect 1025 may be present to provide electrical coupling between a power source (not shown) and the second sections of the rod assembly 1030. In FIG. 10, the rod assembly 1030 comprises four rods though other numbers of rods may be used. As shown in more detail in the sectional view of FIG. 11, a first rod is split into a first section 1042*a* and a second section 1042*b*, and an opposite rod is split into a first section 1052*a* and 1052*b*. The first sections 1042*a*, 1052*a* are separated from the second sections 1042*b*, 1052*b*, at least in part, by a disc 1035. Another disc 1036 is present and is coupled to a second end of the second sections 1042*b*, 1052*b*. The discs 1035, 1036 can isolate the sections from each other to permit different sections to provide different functions. A glass capillary 1115 may be present in the sampling interface to introduce ions into the skimmer cone 1210 (see FIG. 12). The shape of the first sections 1042*a*, 1052*a* permits insertion of the ends of these sections into the backside of the skimmer cone 1210. The ion volume provided by the rods can be positioned so that it is substantially aligned with the center of the opening in the skimmer cone 1210 to receive ions within the center of the gas flow from the capillary 1115. By positioning the entrance aperture of the ion volume close to the opening in the skimmer cone, ions within the center of the gas flow may be better sampled. Electrical couplings 1222, 1224 may be present to electrically couple the rods to a power source (not shown) for generation of an RF field.

Figure 11:
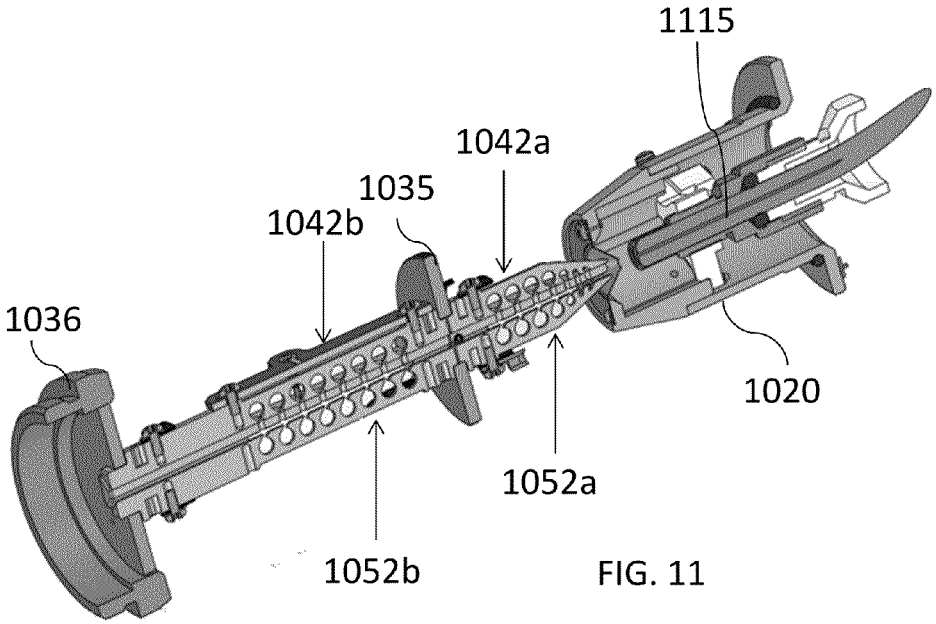
FIG. 11 is a cross-sectional view of the system of FIG. 10, in accordance with certain configurations.
Figure 12:
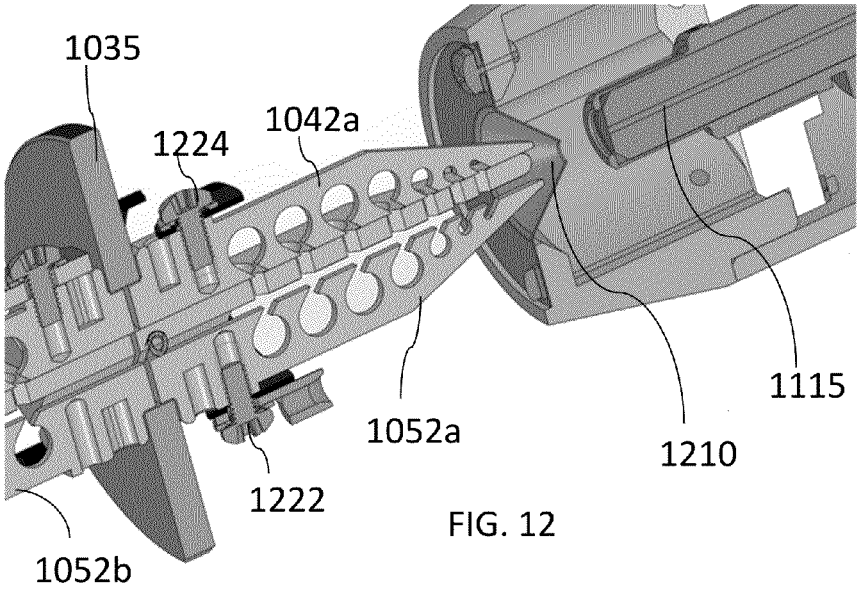
FIG. 12 is a close up view showing the skimmer cone and the inserted rod sections, in accordance with certain examples.
Figure 13:
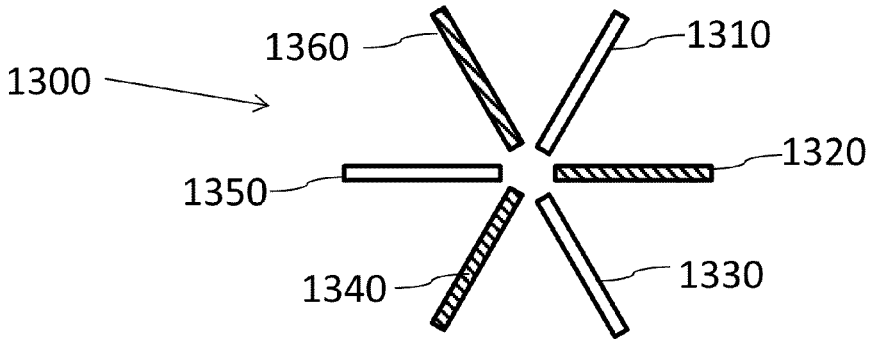
FIG. 13 is an end on view of a hexapolar assembly, in accordance with certain examples.

In certain examples, a hexapolar assembly may be positioned similar to the quadrupole assembly shown in FIGS. 10-12. Referring to FIG. 13, a hexapolar assembly 1300 generally comprises six rods 1310-1360 where at least one of the rods comprises an integral fluid path, e.g., a hole/slot pair or serrations, as described herein. In some configurations, rods 1310, 1330 and 1350 are all charged similarly and rods 1320, 1340 and 1360 are all charged similarly. In some instances, rods that provide opposite poles, e.g., rods 1310 and 1340 or rods 1320 and 1350 or rods 1330 and 1360, may be configured similarly, e.g., each of rods 1310 and 1340 may comprise an integral fluid path configured to provide a fluid path to ion volume formed by the rod assembly to remove fluid from within the ion volume through the fluid path. In some instances, all the positively charged rods may comprise an in integral fluid path configured to provide a fluid path to ion volume formed by the rod assembly to remove fluid, e.g., gas, from within the ion volume through the fluid path. In other configurations, all the negatively charged rods may comprise an integral fluid path configured to provide a fluid path to ion volume formed by the rod assembly to remove fluid from within the ion volume through the fluid path. In certain configurations, each of the rods 1310-1360 may comprise an integral fluid path configured to provide a fluid path to ion volume formed by the rod assembly to remove fluid from within the ion volume through the fluid path. In some instances, the first, second, third, fourth, fifth and sixth poles 1310-1360, respectively, are configured together to select or transmit ions comprising a selected mass-to-charge ratio. As described herein, one or more of the rods 1310-1360 may comprise a first section comprising a width at a first end of the first section that is less than a width at a second end of the first section. Where two or more sections are present for a particular rod, each of the first section and the second section may comprise at least one integral fluid path configured to provide the fluid path between the ion volume and the outer volume. While not shown in FIG. 13, the width at a first end of the first section may be less than a width at a second end of the second section, e.g., to permit insertion of the hexapolar assembly into a skimmer cone. The rod sections may be separated by discs as described in reference to the quadrupole assembly in FIGS. 10-12. If desired the angle of the slots present in the rods 1310-1360 may be the same or may be different, e.g., may be orthogonal or non-orthogonal to an ion travel axis. Similarly, the fluid paths present in the different rods 1310-1360 may be sized similarly or may be sized differently. Where more than four rods are present, it may be desirable to decrease the thickness of each rod so that rods can be arranged close to each other and provide an ion volume with a cross sectional size substantially the same as when four rods are present.

Figure 14:
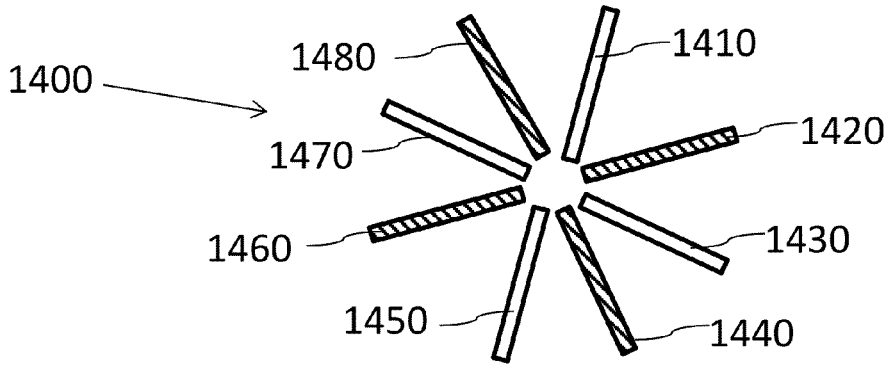
FIG. 14 is an end on view of a octapolar assembly, in accordance with certain examples.

In some instances, an octapolar assembly may be positioned similar to the quadrupole assembly shown in FIGS. 10-12. Referring to FIG. 14, one arrangement of eight rods 1410-1480 is shown though other arrangements are possible. In certain configurations, rods 1410, 1430, 1450 and 1470 are all charged similarly and rods 1420, 1440, 1460 and 1480 are all charged similarly. In some instances, two or more rods of opposite charge, e.g., rods 1410 and 1440, may be configured similarly, e.g., each of rods 1410 and 1440 may comprise an integral fluid path configured to provide fluidic coupling between an ion volume and an outer volume. In some instances, all the positively charged rods may comprise an integral fluid path. In other configurations, all the negatively charged rods may comprise an integral fluid path. In certain configurations, each of the rods 1410-1480 may comprise an integral fluid path. In some instances, the first, second, third, fourth, fifth, sixth, seventh and eighth poles 1410-1480, respectively, are configured together to select or transmit ions comprising a selected mass-to-charge ratio. As described herein, one or more of the rods 1410-1480 may comprise a first section comprising a width at a first end of the first section that is less than a width at a second end of the first section. Where two or more sections are present for a particular rod, each of the first section and the second section may comprise at least one integral fluid path. While not shown in FIG. 14, the width at a first end of the first section may be less than a width at a second end of the second section, e.g., to permit insertion of the octapolar assembly into a skimmer cone. The rod sections may be separated by discs as described in reference to the quadrupole assembly in FIGS. 10-12. If desired the angle of the slots present in the fluid paths of the rods 1410-1480 may be the same or may be different. Similarly, the holes (where present) in the different rods 1410-1480 may be sized similarly or may be sized differently. Where eight rods are present, it may be desirable to decrease the thickness of each rod so that rods can be arranged close to each other and provide an ion volume with a cross-sectional size substantially the same as when four rods are present.

In some examples, the rods and/or rod sections described herein can be used in rod assemblies that include fewer than four poles. For example, the rods and/or rod sections may be used in a tripole or a dipole to reduce the pressure through such systems. While the exact configuration may vary, in some instances the first rod section may include an integral fluid path, whereas in other examples, each of a first rod section and a second rod section may include an integral fluid path. It will be within the ability of the person of ordinary skill in the art, given the benefit of this disclosure, to select suitable rods and rod sections for use in rod assemblies other than quadrupoles, hexapoles and octupoles.

In some embodiments, two or more slots may be present for a single hole or aperture present in the integral fluid path. For example, the slots may take the form of serrations each of which provides a fluid path between the hole and the ion volume formed by the rod assembly. In some instances, two, three or more slots or serrations may be present and fluidically coupled to a hole or aperture present in a body of the rod.

In some instances, the rods and/or rod sections may comprise one or more conductive materials that can receive a current from a power source. For example, the rods may comprise stainless steel, gold, platinum, silver or other conductive materials. In some embodiments, a conductive coating or plating may be added to the rods, whereas in other instances the entire rod body may comprise the conductive material. In preparing the rods or rod sections, the holes/slots may be laser cut or material may otherwise be removed from a generally planar body to provide the rod sections and/or the hole/slot pairs. The thickness of the rods may be selected to provide suitable conductivity while at the same time permitting close spacing of the rod ends to provide an inner space of a suitable size.

Figure 15:
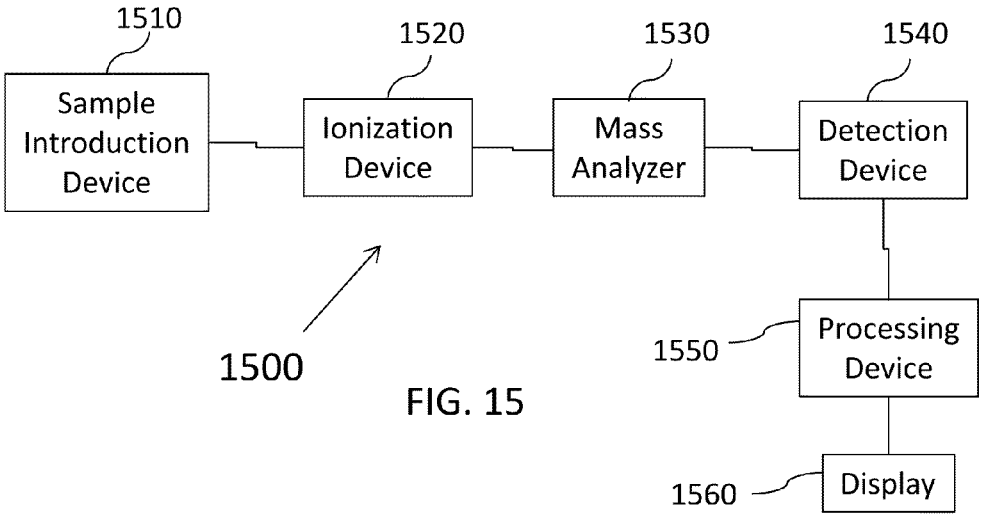
FIG. 15 is a block diagram of a mass spectrometer, in accordance with certain embodiments.

In certain embodiments, the rod assemblies described herein may be present in a mass spectrometer. While the number and type of components may vary from mass spectrometer (MS) to mass spectrometer, an illustration of certain components is shown in FIG. 15. The MS device 1500 includes a sample introduction device 1510, an ionization device 1520, a mass analyzer 1530, a detection device 1540, a processing device 1550 and a display 1560. The sample introduction device 1510, ionization device 1520, the mass analyzer 1530 and the detection device 1540 may be operated at reduced pressures using one or more vacuum pumps. In certain examples, however, only the mass analyzer 1530 and the detection device 1540 may be operated at reduced pressures. The sample introduction device 1510 may include an inlet system configured to provide sample to the ionization device 1520. The inlet system may include one or more batch inlets, direct probe inlets and/or chromatographic inlets. The sample introduction device 1510 may be an injector, a nebulizer or other suitable devices that may deliver solid, liquid or gaseous samples to the ionization device 1520. If desired, the sample introduction device 1510 may be fluidically coupled to a chromatography system, e.g., a gas or liquid chromatography system, and can receive separated analytes from the chromatography system. The ionization device 1520 may be any one or more ionization devices commonly used in mass spectrometer, e.g., may be any one or more of the devices which can atomize and/or ionize a sample including, for example, plasma (inductively coupled plasmas, capacitively coupled plasmas, microwave-induced plasmas, etc.), arcs, sparks, drift ion devices, devices that can ionize a sample using gas-phase ionization (electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices. The mass analyzer 1530 may take numerous forms depending generally on the sample nature, desired resolution, etc., and exemplary mass analyzers can include one or more of the rod assemblies described herein or other components as desired. The detection device 1540 may be any suitable detection device that may be used with existing mass spectrometers, e.g., electron multipliers, Faraday cups, coated photographic plates, scintillation detectors, etc., and other suitable devices that will be selected by the person of ordinary skill in the art, given the benefit of this disclosure. The processing device 1550 typically includes a microprocessor and/or computer and suitable software for analysis of samples introduced into MS device 1500. One or more databases may be accessed by the processing device 1550 for determination of the chemical identity of species introduced into MS device 1500. Other suitable additional devices known in the art may also be used with the MS device 1500 including, but not limited to, autosamplers, such as AS-90plus and AS-93plus autosamplers commercially available from PerkinElmer Health Sciences, Inc.

In certain embodiments, the mass analyzer 1530 of the MS device 1500 may take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers (e.g., matrix-assisted laser desorbed ionization time of flight analyzers), and other suitable mass analyzers that may separate species with different mass-to-charge ratios and may comprise one or more of the collision cells described herein. In some embodiments, the mass analyzer 1530 may comprise one of the rod assemblies described herein, e.g., a quadrupole rod assembly, hexapole rod assembly or octupole rod assembly with one or more of the rods comprising an integral fluid path configured to provide fluidic coupling between an ion volume and an outer volume. In other instances, two or more rods present in the mass analyzer 1530 may each comprise an integral fluid path. In some configurations, each rod of the mass analyzer 1530 may comprise an integral fluid path.

Figure 16:
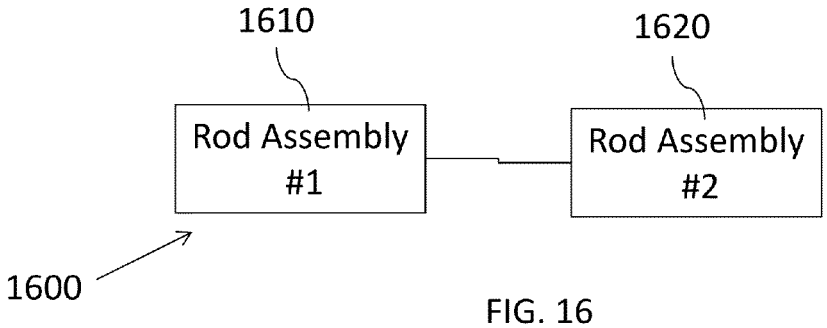
FIG. 16 is a block diagram of two rod assemblies fluidically coupled to each other, in accordance with certain examples.

In certain embodiments, the rod assemblies described herein may be present in a first stage that is coupled to a second device comprising a rod assembly. Referring to FIG. 16, a first rod assembly 1610 is fluidically coupled to a second rod assembly 1620 such that ions may be provided from one assembly to the other. In a first configuration, the first assembly 1610 may comprise a quadrupole, hexapolar or octapolar rod assembly as described herein, e.g., where at least one rod of the rod assembly comprises an integral fluid path. In some instances, the second rod assembly 1620 may be configured as a conventional quadrupole rod assembly or a quadrupole rod assembly as described herein. In other instances, the second rod assembly may be configured as a hexapole rod assembly or an octupole rod assembly. The assemblies 1610, 1620 may be coupled directly to each other, e.g., without any intervening components or systems, or may be indirectly coupled to each other, e.g., separated by one or more other components or system.

Figure 17:
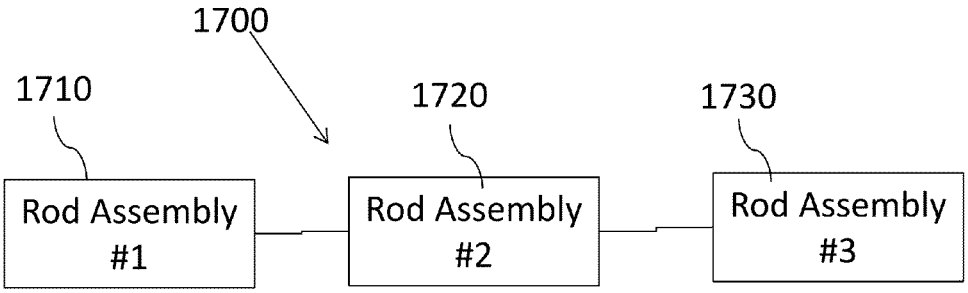
FIG. 17 is a block diagram of three rod assemblies fluidically coupled to each other, in accordance with certain configurations.

In additional configurations, a system comprising more than two rod assemblies in which at least one of the rod assemblies comprises a rod assembly as described herein, e.g., a rod assembly where at least one rod comprises an integral fluid path is provided. Referring to FIG. 17, a system 1700 comprises three rod assemblies 1710, 1720 and 1730 coupled to each other. In a first configuration, one of the rod assemblies 1710-1730 may comprise one or more of the rods described herein, e.g., a rod with an integral fluid path. In other instances, two of the rod assemblies 1710-1730 may comprise one or more rods as described herein, e.g., a rod with a hole/slot pair or serrations configured to provide a fluid path to an ion volume to remove fluid from within the ion volume. In other instances, each of the rod assemblies 1710-1730 may comprise one or more rods as described herein, e.g., a rod with an integral fluid path. The rod assemblies 1710-1730 may be coupled directly to each other, e.g., without any intervening components or systems, or may be indirectly coupled to each other, e.g., separated by one or more other components or system. In some instances, one of the rod assemblies 1710-1730 may comprise a quadrupole assembly as described herein, and another rod assembly may comprise a hexapole or octupole rod assembly. In other instances, one of the rod assemblies 1710-1730 may comprise a hexapole assembly as described herein and another rod assembly may comprise a quadrupole or octupole rod assembly. In some configurations, one of the rod assemblies 1710-1730 may comprise an octupole assembly as described herein and another rod assembly may comprise a quadrupole or hexapole rod assembly. In additional configurations, each of the three rod assemblies 1710-1730 may be configured as a quadrupole rod assembly as described herein. In some configurations, each of the three rod assemblies 1710-1730 may be configured as a hexapole rod assembly as described herein. In some instances, each of the three rod assemblies 1710-1730 may be configured as an octupole rod assembly as described herein. Even though three rod assemblies are shown in FIG. 17, more than three rod assemblies may be present in a system if desired, e.g., four, five, six or more rod assemblies may be present in the system.

In some examples, the MS devices disclosed herein may be hyphenated with one or more other analytical techniques. For example, MS devices may be hyphenated with devices for performing liquid chromatography, gas chromatography, capillary electrophoresis, and other suitable separation techniques. When coupling an MS device with a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces may be used so that only a small amount of sample exiting the liquid chromatograph may be introduced into the MS device. Sample exiting from the liquid chromatograph may also be deposited in suitable wires, cups or chambers for transport to the ionization devices of the MS device. In certain examples, the liquid chromatograph may include a thermospray configured to vaporize and aerosolize sample as it passes through a heated capillary tube. Other suitable devices for introducing liquid samples from a liquid chromatograph into a MS device will be readily selected by the person of ordinary skill in the art, given the benefit of this disclosure. In certain examples, MS devices can be hyphenated with each other for tandem mass spectroscopy analyses.

In certain embodiments, the rods and rod sections described herein may be packaged in the form of a kit to permit a user to assemble a rod assembly having a desired configuration. For example, a kit may include a rod comprising at least one hole/slot pair configured to provide a fluid path to an ion volume formed by the rod assembly to remove fluid from within the ion volume through the fluid path, and the kit may also include instructions for using the rod to assemble the rod assembly. In some embodiments, enough rods may be present in the kit so that a quadrupole rod assembly can be assembled using the rods and the instructions. In other embodiments, enough rods may be present so that a hexapole rod assembly can be assembled using the rods and the instructions. In additional embodiments, enough rods may be present so that an octupole rod assembly can be assembled using the rods and the instructions. In some instances, the kit may comprise one, two, three, four or more rods each of which may comprise an integral fluid path. In other instances, each rod of the kit may comprise an integral fluid path. If desired, the kit may include rod sections, e.g., a first section and a second section separate from the first section and configured to electrically couple to the first section. The rod sections can be assembled by a user to provide a rod with a desired configuration. For example, the kit can include a plurality of rods in which each rod comprises a first section and a second section separate from the first section and configured to electrically couple to the first section, in which the first section of each of the rods comprises at least one integral fluid path. If desired, the second section of each of the plurality of rods comprises at least one integral fluid path. In other configurations, one or more discs or insulative inserts can be packaged in the kits to permit a user to separate various rod sections and/or alter the overall size of the ion volume formed by rod sections.

In some instances, the pressure in a mass spectrometer stage can be reduced using one or more of the rod assemblies described herein. For example, at least one rod configured to form a rod assembly can be provided with a plurality of additional rods to provide a plurality of poles. The at least one rod comprises at least one integral fluid flow path. A pump, e.g., a vacuum pump, can be fluidically coupled to the ion volume by way of the integral fluid path and the outer volume to reduce the pressure in the mass spectrometer stage. The vacuum open nature provided by the integral fluid paths permits the use of cheaper and less efficient pumps while at the same time rapidly reducing the pressure. If desired, the rod may be configured with a plurality of integral fluid paths. In some configurations, at least two of the plurality of integral fluid paths are sized and arranged to be different. The rod assembly may be configured as a quadrupole rod assembly, a hexapole rod assembly, an octupole rod assembly or as assemblies with two or more rods present. In some instances, each rod of the rod assembly may be configured to comprise at least integral fluid path to provide the fluid path to inner space formed by the rod assembly to remove fluid from within the ion volume.

Certain specific examples are described to facilitate a better understanding of the technology described herein.

Example 1

Figure 18:
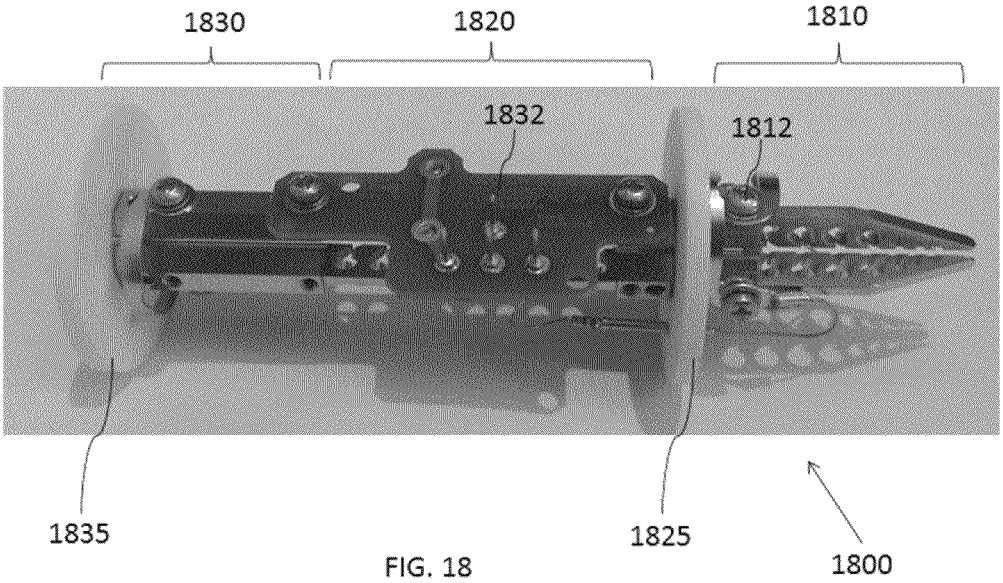
FIG. 18 is a photograph of a device comprising a quadrupole rod assembly suitable for use in liquid chromatography-mass spectrometry application, for example.

A quadrupole rod assembly was assembled comprising four stainless steel rods each of which was constructed to be substantially the same. Referring to FIG. 18, a photograph of a rod assembly constructed for use, for example, in liquid chromatography mass spectrometry systems. The device 1800 comprises four rods positioned in a quadrupole arrangement to provide an inner space comprising a substantially square cross section is shown, e.g., an ion volume with a square cross section. The first sections of the four rods are grouped as element 1810, and a segment of the second sections of the four rods are grouped as element 1820. While the exact dimensions of the rod sections can vary, the rod sections grouped as element 1810 may each be about 25-45 mm long, and the rod sections grouped as element 1820 may each be about 30-50 mm long. The first sections 1810 and the second sections 1820 are separated, at least in part, by a ceramic disc 1825. Another segment 1830 of the second section may be solid and lack any integral fluid paths. A second ceramic disc 1835 is coupled to the second end of the second sections 1820. Electrical couplings 1812, 1832 are present to provide an electrical connection to a power source and the different rod sections. The top outer surface of each of the rod sections is solid, whereas the bottom inner surface of each rod section comprises angled slots or serrations that each connects to a transverse hole in the body of the rod section. One or more fluid connections may also be present to provide a fluid path from the ion volume formed by the rods, through the serrations and to a pump (not shown) to remove gas from the ion volume of the device 1800. In operation, the pressure within the inner space formed by rod sections 1810 differs from the pressure within the inner space formed by rod sections 1820.

Example 2

Pressure measurements were made at various sections of the rod assembly of Example 1. The ion volume was 4.5 mm by 4.5 mm square with about 1 mm spacing between hexagonal shaped rods. The length of the rod surfaces that were adjacent to each other was about 4 mm. The section 1810 was about 30 mm in length (along the direction of the ion travel axis), and the section 1820 was about 40 mm in length. Section 1830 was about 30 mm in length. An atmospheric pressure interface (API) was used in a liquid chromatography-mass spectrometer (LC-MS). The pressure at the API was about 759.8 Torr. The multipole assembly of FIG. 18 was placed in the instrument, which included a glass capillary (0.56 mm diameter by 380 mm in length) and a skimmer cone upstream, e.g., between the multipole assembly and the API, of the instrument. Various stages of the turbopump of the LC-MS system were fluidically coupled to different sections of the multipole assembly, with one stage fluidically coupled to the section 1810, a second stage fluidically coupled to the section 1820, and another stage fluidically coupled to an orifice at the disc 1835.

During operation of the instrument, upstream of section 1810, e.g., at the skimmer cone, the pressure in the system was measured to be about 1.4 Torr. At section 1810, the pressure was measured to be about 0.17 Torr. At the second disc section 1820, the pressure was not measured but was estimated to be about $2\times10^{-3}$ Torr. At the orifice near the disc 1835, the pressure was measured to be about $6\times10^{-6}$ Torr. The measurements were consistent with integral fluid paths in the multipole assembly providing a rapid drop in pressure over a relatively small longitudinal length.

Example 3

Similar measurements were performed using the system of Example 2, but the size of the ion volume was 3 mm by 3 mm square. During operation of the instrument, upstream of section 1810, e.g., at the skimmer cone, the pressure in the system was measured to be about 1.4 Torr. At section 1810, the pressure was measured to be about 0.19 Torr. At the second disc section 1820, the pressure was not measured but was estimated to be about $1\times10^{-3}$ Torr. At the orifice near the disc 1835, the pressure was measured to be about $5.7\times10^{-6}$ Torr. The measurements were consistent with integral fluid paths in the multipole assembly providing a rapid drop in pressure over a relatively small longitudinal length even where the size of the ion volume is altered.

Example 4

Based on the measurements taken in Examples 1 and 2, the size of the ion volume was altered to provide as large a pressure drop as possible based on the dimensions of the sections in FIG. 18. It was determined by calculations that an ion volume of about 3.5 mm by 3.5 mm would provide a pressure of about 0.17 Torr at section 1810, a pressure of about $6\times10^{-4}$ Torr at section 1820 and a pressure of about $4\times10^{-7}$ Torr at the orifice near disc 1835.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A device comprising a multipole assembly comprising a plurality of poles, in which at least one of the poles of the multipole assembly comprises an integral fluid path that fluidically couples an ion volume formed by the poles of the multipole assembly to an outer volume of the multipole assembly, in which the integral fluid path is configured to decrease a pressure of a second section of the multipole assembly downstream of a first section of the multipole assembly comprising the integral fluid path by drawing gas from the ion volume into the outer volume, in which the first section and the second section are electrically coupled to each other to permit an effective field to be provided by the multipole assembly to transmit ions through the first section and the second section of the multipole assembly.

2. The device of claim 1, in which the poles of the multipole assembly are configured together to transmit ions of a selected mass-to-charge ratio range.

3. The device of claim 1, in which the first section comprises a width at a first end of the first section that is less than a width at a second end of the first section.

4. The device of claim 3, in which the second section comprises a second integral fluid flow path.

5. The device of claim 1, in which at least two opposite poles of the multipole assembly are configured with an integral fluid path effective to remove fluid from the ion volume to the outer volume.

6. The device of claim 1, in which multipole assembly comprises at least separate three sections electrically coupled to each other with each section of the multipole assembly configured with an integral fluid path effective to remove fluid from the ion volume to the outer volume to decrease pressure downstream of each section of the multipole assembly.

7. The device of claim 5, in which the opposite poles of the multipole assembly comprise an integral fluid path that each comprise a width at a first end that is less than a width at a second end.

8. The device of claim 7, in which the opposite poles comprising the integral fluid path each comprise two or more sections electrically coupled to each other.

9. The device of claim 8, in which each of the sections of each of the opposite poles comprises an integral fluid path effective to remove gas from the ion volume to the outer volume.

10. The device of claim 1, in which the integral fluid path is arranged at a non-orthogonal angle to an ion travel axis of the multipole assembly.

11. The device of claim 1, in which the multipole assembly is configured as a quadrupole assembly.

12. The device of claim 11, in which each of first, second, third and fourth poles of the quadrupole assembly comprises a first section comprising an integral fluid path that fluidically couples the ion volume formed by the poles of the quadrupole assembly to an outer volume of the quadrupole assembly.

13. The device of claim 12, in which each integral fluid path is arranged at a non-orthogonal angle to an ion travel axis of the quadrupole assembly.

14. The device of claim 1, in which the multipole assembly is configured as a hexapole assembly.

15. The device of claim 14, in which each of first, second, third, fourth, fifth and sixth poles of the hexapole assembly comprises a first section comprising an integral fluid path that fluidically couples the ion volume formed by the poles of the hexapole assembly to an outer volume of the hexapole assembly.

16. The device of claim 15, in which each integral fluid path is arranged at a non-orthogonal angle to an ion travel axis of the hexapole assembly.

17. The device of claim 1, in which the multipole assembly is configured as an octupole assembly.

18. The device of claim 17, in which each of first, second, third, fourth, fifth, sixth, seventh and eighth poles of the octupole assembly comprises a first section comprising an integral fluid path that fluidically couples the ion volume formed by the poles of the octupole assembly to an outer volume of the octupole assembly.

19. The device of claim 18, in which each integral fluid path is arranged at a non-orthogonal angle to an ion travel axis of the octupole assembly.

20. The device of claim 1, in which the integral fluid path of the first section comprises a plurality of individual apertures each comprising a respective serration, in which each of the plurality of individual apertures in the first section comprises a different size from other apertures in the first section.

* * * * *